United States Patent [19]

Stevers

[11] 3,972,628

[45] Aug. 3, 1976

[54] WRITING INSTRUMENT SUPPORT

[76] Inventor: Robert Glenn Stevers, 8521 Crenshaw, Inglewood, Calif. 90305

[22] Filed: Sept. 8, 1975

[21] Appl. No.: 611,518

[52] U.S. Cl. ..... 401/48; 401/6; 15/443

[51] Int. Cl.[2] ..... B43K 23/00

[58] Field of Search ..... 401/48, 6–8; 3/12.8; 15/437, 443

[56] References Cited

UNITED STATES PATENTS

| | | | |
|---|---|---|---|
| 426,324 | 4/1890 | Ramsey | 15/443 |
| 825,985 | 7/1906 | Schwertenberg | 401/6 |
| 2,497,418 | 2/1950 | Schroeder | 401/48 |

*Primary Examiner*—Lawrence Charles

[57] ABSTRACT

A hand writing aid for use with writing instruments such as pens and pencils. The aid is specifically designed for use by persons troubled with shaking of the hands or stiffness of the fingers to enable such persons to write smoothly and legibly.

5 Claims, 4 Drawing Figures

WRITING INSTRUMENT SUPPORT

BACKGROUND OF THE INVENTION

1. Field of the Invention

This invention relates to attachments for writing instruments and more specifically to a hand writing aid which facilitates holding the writing instrument and, at the same time, steadies the hand of the writer.

2. Discussion of the Prior Art

Various writing instrument attachments have been heretofore proposed for assisting the writer. Many of these attachments have been designed to improve the writer's penmanship by forcing him to correctly grip the writing instrument and to properly position it relative to the writing surface. Other types of attachments have been devised for the purpose of lessening fatigue and eliminating so-called "writers' cramp". Still other types of writing instrument attachments have been proposed for the purpose of providing guides for correct spacing of the successive lines of the writing. As a general rule, these various prior art devices have been of rather complex design, many involving gripping members of irregular shape, and several embodying numerous moving parts. The complexity of the devices have often made them difficult to use and costly to manufacture.

The following patents, which represent the closest art known to applicant, are exemplary of the aforementioned types of writing instrument attachments:

| | | | |
|---|---|---|---|
| 825,985 | De Schwertenberg | 1,840,191 | Eubanks |
| 1,342,576 | Wride | 1,818,081 | Mingos |
| 1,669,755 | Hopper | | |

The objectives of the present invention, unlike those of the prior art patents, is not to improve handwriting skills per se, but rather is to provide a simple, inexpensive, and easy to use attachment for use by persons handicapped by stiffness or by shaking of the hand. These difficulties may result from an arthritic condition, palsy, or a variety of reasons, including the infirmities of age. Frequently, persons suffering with these afflictions have great difficulty in writing legibly and sometimes cannot even sign their name without inordinate pain and effort.

As will be more fully appreciated from the description which follows, the device of the present invention provides a simple, inexpensive means whereby a person afflicted with stiffness or shaking can write quite legibly, with a smooth stroke. Because the device is compact and highly durable, the user can take it with him wherever he goes and can have it readily available for preparing checks, receipts and other types of documents. Since the principal function of the device is to facilitate gripping and to steady the writer's hand, its design takes on considerably different characteristics from the devices of the prior art and fortuitously is much easier to manufacture and use.

SUMMARY OF THE INVENTION

It is a principal object of the present invention to provide an attachment for a writing instrument such as a pen or pencil which can be easily gripped and used as a steadying support by persons troubled with stiff fingers or shaking hands to enable them to write or print smoothly and legibly.

More specifically, it is an object of the invention to provide an attachment of the aforementioned character which includes a base portion adapted to slidably engage the writing surface and an upwardly extending support member which can readily be gripped by the user with his thumb and forefingers. The support member is arranged to carry the writing instrument in the correct orientation with respect to the writing surface so that the user can securely grip the attachment and move it and the writing instrument along the writing surface with the attachment serving to effectively dampen out the shaking or trembling of the user's hand.

It is another object of the invention to provide an attachment of the type described in which the writing instrument is removable so that the attachment can be easily carried in the user's pocket and can be conveniently used during banking operations or at other times when the user is required to write or sign his name when away from home.

It is still another object of the invention to provide a writing instrument attachment which is durable, compact, is of simple design, involves no moving parts, can be constructed of various materials, and can be readily and inexpensively mass produced.

In summary, these and other objects of the invention are realized by a hand writing aid for use with writing instruments, such as pens and pencils, used for writing on substantially flat writing surfaces comprising a base adapted to rest upon the writing surface, and an upwardly extending member carried by the base and adapted to be gripped by the user. The upwardly extending member includes an angularly extending top wall to supportedly carry the writing instrument. Gripping members are provided for positioning the writing instrument on the top wall of the upwardly extending member so that the writing point of the writing instrument is in engagement with the writing surface.

DESCRIPTION OF ONE FORM OF THE INVENTION

Figure 1:
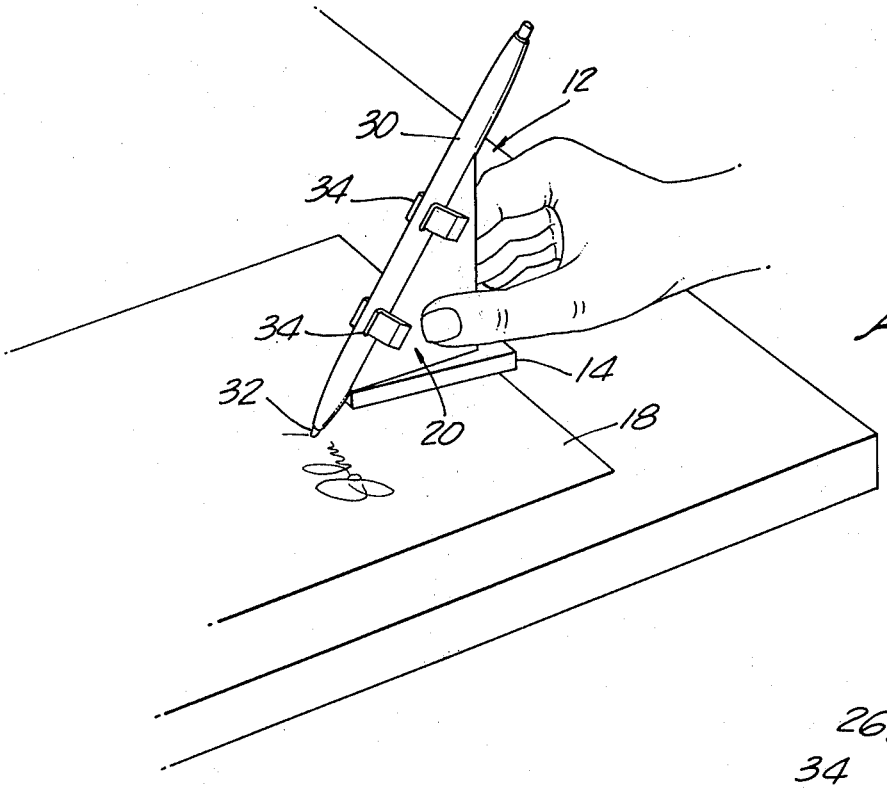
FIG. 1 is a perspective view of the hand writing aid of the present invention illustrating its manner of use.
Figure 2:
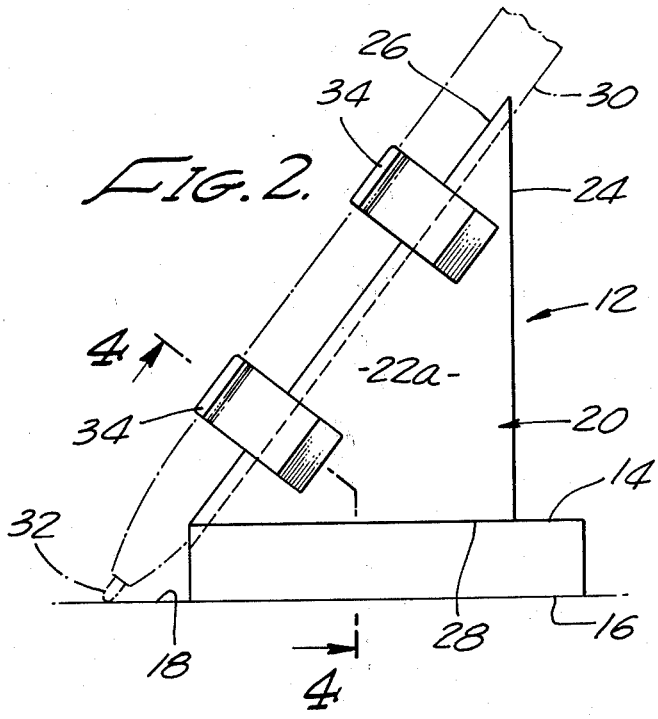
FIG. 2 is a side elevational view of the writing aid showing in phantom lines the position of the writing instrument when it is removably affixed to the writing aid.

Referring to the drawings, and particularly to FIGS. 1 and 2, the hand writing or steadying aid of the present invention is generally designated by the numeral 12. It comprises a base 14 having a generally planar bottom face 16 which is adapted to slidably engage the flat writing surface designated by the numeral 18 in FIG. 1, and a support member 20 carried by base 14. Support member 20 extends upwardly from base 14 and is adapted to be gripped by the thumb and forefingers of the writer in the manner shown in FIG. 1. It is to be noted that the device can be securely gripped with the fingers of the user remaining relatively straight. Curling or bending of the fingers, as is necessary in gripping a writing instrument in the normal fashion, is not required. Member 20 can be affixed to base 14 in any suitable manner such as by bonding or by the use of appropriate connector means. For certain applications, base 14 and member 20 may be integral and formed from a single piece of material.

Figure 4:
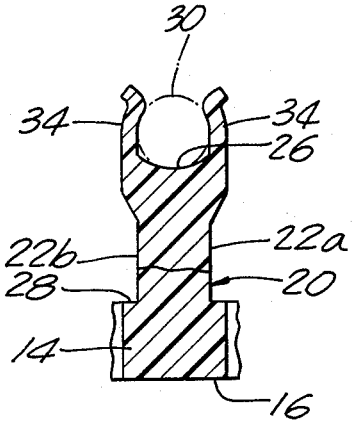
FIG. 4 is a cross-sectional view taken along lines 4—4 of FIG. 2.

Referring particularly to FIGS. 2 and 4, member 20 can be seen to comprise a pair of spaced apart triangularly shaped generally parallel side walls 22*a* and 22*b*, an end wall 24 connecting the side walls and extending substantially vertically upwardly from base 14, a top wall 26 connecting the side walls and extending angularly upwardly from base 14, and a bottom wall 28 connecting the side walls and lying in a plane substantially parallel with the plane of bottom face 16 of base 14. In the embodiment of the invention shown in the drawings, top wall 26 is curved for receiving the writing instrument, which is generally designated as 30.

Figure 3:
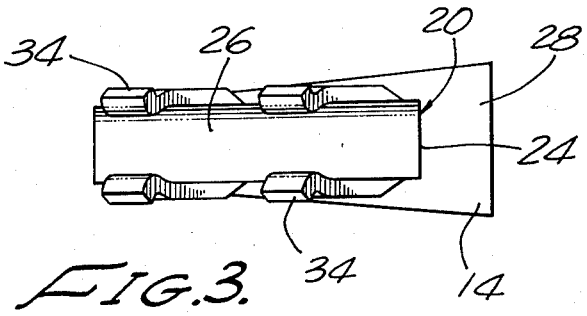
FIG. 3 is a plan view of the writing aid.

Turning to FIGS. 2 and 3, the hand writing aid of this form of the invention is shown to include gripping means for positioning the writing instrument 30 on top wall 26 of the support member so that the writing point 32 of the writing instrument is in engagement with the writing surface 18. In the embodiment of the invention shown, the gripping means is in the form of spring means carried by the support member 20 for releasably gripping the writing instrument 30. These latter means comprise two pairs of spaced apart gripping ears 34 adapted to releasably grip the writing instrument 30. Gripping ears 34 may be formed of a resilient plastic material and may be integral with support member 20 or may be separate elements suitably connected to support member 20 as by bonding or the like. Alternatively, gripping ears 34 may be constructed of metal segments which are suitably formed to springably grip the writing instrument. The hand writing aid of the present invention can be constructed of a wide variety of materials such as a moldable plastic, wood, metal, or other materials. It may be formed as a single piece, or may be made of separate elements suitably interconnected in the configuration shown in the drawings.

Having now described the invention in detail in accordance with the requirements of the patent statutes, those skilled in this art will have no difficulty in making changes and modifications in the individual parts of their relative assembly in order to meet specific requirements or conditions. Such changes and modifications may be made without departing from the scope and spirit of the invention, as set forth in the following claims.

I claim:

1. A hand writing aid for use with writing instruments such as pens and pencils used for writing on substantially flat writing surfaces comprising:

a. a base adapted to rest upon the writing surface;

b. an upwardly extending member carried by said base and adapted to be gripped by the writer, said member including an angularly extending top wall to supportably carry the writing instrument; and c. gripping means for positioning the writing instrument on said top wall with the writing point thereof in engagement with the writing surface.

2. A hand writing aid for use with a writing instrument having a writing point, comprising:

a. a base having a generally planar bottom face;

b. a support member carried by said base for supporting the writing instrument comprising:

1. a pair of spaced apart triangularly shaped generally parallel side walls;
2. an end wall connecting said side walls and extending substantially vertically upwardly from said base;
3. a top wall connecting said side walls and extending angularly upwardly from said base; and c. gripping means for holding the writing instrument in engagement with said top wall so that the writing point of the instrument is coplanar with the plane of the bottom face of said base.

3. The hand writing aid as defined in claim 2 in which said gripping means comprises spring means carried by said support member for releasably gripping the writing instrument, said means including at least one pair of spaced apart gripping ears formed of a resilient material and extending upwardly from said top wall.

4. The hand writing aid as defined in claim 3 in which said top wall is curved for receiving the writing instrument and in which said spring means comprises two pairs of spaced apart gripping ears carried by said top wall.

5. A steadying aid for use by persons troubled with shaking, said aid being adapted to be used with writing instruments such as pens and pencils used for writing on substantially flat writing surfaces, comprising:

a. a base having a generally planar bottom face adapted to slidably engage the flat writing surface;

b. a support member fixedly connected to said base for supporting the writing instrument comprising:

1. a pair of spaced apart triangularly shaped generally parallel side walls;
2. an end wall connecting said side walls and extending substantially vertically upwardly from said base;
3. a top wall connecting said side walls and extending angularly upwardly from said base, said top wall being curved for receiving the writing instrument;
4. a bottom wall connecting said side walls and lying in a plane substantially parallel with said bottom face of said base; and c. gripping means for holding the writing instrument in engagement with said top wall so that the writing point of the instrument is coplanar with the plane of the bottom face of said base, said gripping means comprising two pairs of spaced apart gripping ears connected to said top wall for releasably gripping the writing instrument.

* * * * *